US009773443B2

(12) United States Patent
Limketkai et al.

(10) Patent No.: US 9,773,443 B2
(45) Date of Patent: Sep. 26, 2017

(54) THIN FILM TRANSISTOR DISPLAY BACKPLANE AND PIXEL CIRCUIT THEREFOR

(71) Applicant: Intel Corporation, Santa Clara, CA (US)

(72) Inventors: Benjie N. Limketkai, Lynnwood, WA (US); Youssry Y. Botros, Stevenson Ranch, CA (US)

(73) Assignee: Intel Corporation, Santa Clara, CA (US)

( * ) Notice: Subject to any disclaimer, the term of this patent is extended or adjusted under 35 U.S.C. 154(b) by 120 days.

(21) Appl. No.: 13/911,402

(22) Filed: Jun. 6, 2013

(65) Prior Publication Data

US 2014/0362062 A1 Dec. 11, 2014

(51) Int. Cl.
*G09G 3/20* (2006.01)
*G09G 3/3233* (2016.01)
(Continued)

(52) U.S. Cl.
CPC ..... *G09G 3/2014* (2013.01); *G09G 3/325* (2013.01); *G09G 3/3233* (2013.01);
(Continued)

(58) Field of Classification Search
CPC ..... G09G 3/3208; G09G 2300/0809; G09G 2300/0408; G09G 2300/0439;
(Continued)

(56) References Cited

U.S. PATENT DOCUMENTS 7,839,099 B2 * 11/2010 Ball et al. ..... 315/307
7,864,141 B2 * 1/2011 Goh ..... G09G 3/3233 313/504
(Continued)

FOREIGN PATENT DOCUMENTS

JP 2004-145069 * 5/2004
JP 2004145069 A 5/2004
(Continued)

OTHER PUBLICATIONS

Lee, Hojin, "Active Matrix Organic Light-Emitting Displays: Novel Amorphous Silicon Thin-Film Transistors and Pixel Electrode Circuits", dissertation, 2008, 173 pages, Hojin Lee, Ann Arbor, MI.
(Continued)

*Primary Examiner* — Kent Chang
*Assistant Examiner* — Scott Au
(74) *Attorney, Agent, or Firm* — Alpine Technology Law Group LLC

(57) ABSTRACT

Briefly, in accordance with one or more embodiments, a pixel circuit to drive an electro-optical element of a display backplane comprises an element driver coupled to the electro-optical element, a programming switch coupled to the element driver, and a driver switch coupled to the programming switch and the element driver. The driver switch is capable of controlling when the element driver is turned on or turned off, and is capable of pulse-width modulating the drive current provided to the electro-optical element, for example to provide a lower drive current to the electro-optical element.

21 Claims, 11 Drawing Sheets

(51) Int. Cl.
*G09G 3/325* (2016.01)
*G09G 3/3258* (2016.01)

(52) U.S. Cl.
CPC ... *G09G 3/3258* (2013.01); *G09G 2300/0852* (2013.01); *G09G 2300/0876* (2013.01); *G09G 2310/0259* (2013.01); *G09G 2310/066* (2013.01)

(58) Field of Classification Search
CPC ... G09G 3/325; G02F 1/1368; G02F 1/13306; G02F 1/13624; G06F 3/044; G06F 17/30038
USPC ..... 345/205, 214, 82
See application file for complete search history.

(56) References Cited

U.S. PATENT DOCUMENTS 8,624,808 B2 * 1/2014 Nathan et al. ..... 345/82
2004/0251844 A1 12/2004 Hashido et al.
2005/0269959 A1 * 12/2005 Uchino et al. ..... 315/169.3
2007/0126665 A1 * 6/2007 Kimura ..... 345/76
2009/0135166 A1 * 5/2009 Uchino ..... G09G 3/006 345/205
2012/0242615 A1 * 9/2012 Teraguchi et al. ..... 345/174
2012/0249595 A1 10/2012 Feinstein

FOREIGN PATENT DOCUMENTS

KR 1020080062307 A 7/2008
KR 1020100124338 A 11/2010

OTHER PUBLICATIONS

International Preliminary Report on Petentability received for International Application No. PCT/US2014/038716, issued on Dec. 8, 2015, 12 pages.
International Search and Written Opinion received for International Application No. PCT/US2014/038716, mailed on Oct. 21, 2014.

* cited by examiner

THIN FILM TRANSISTOR DISPLAY BACKPLANE AND PIXEL CIRCUIT THEREFOR

BACKGROUND

In a display utilizing current-driven electro-optical elements, for example an organic light-emitting diode (OLED) and/or metal-oxide light-emitting diode (MOLED), in order to continuously run current through the OLED during a frame time, the time before a row of pixels is re-addressed in the subsequent frame, at least two thin-film transistors (TFTs) are provided at each pixel. In a typical 2T-1C configuration comprising two TFTs and one capacitor for one OLED pixel, the switch TFT turns on during programming time for the single row. The data voltage is applied at the data column line to set the storage capacitor to a particular voltage. When the switch TFT is turned "OFF," the next program row is turned "ON" and programmed During the frame time, the storage capacitor maintains the data voltage. This data voltage sets the gate bias for the drive TFT that in turn sets the current through the OLED.

One of the biggest technological challenges for OLED technology is dealing with electrical non-uniformity and degradation mechanisms of the OLED and TFT. Over time, with electrical stress, the electrical properties of the TFT and OLED will degrade. If the OLED degrades wherein at the same voltage the OLED outputs a lower current, then the pixel brightness may be impacted. Non-uniformity and degradation of the TFTs may lead to poor display quality as a result.

To address the OLED degradation and non-uniformity, the drive TFT may be operated as a current source in the saturation regime. However, there is still the problem of drive TFT degradation and non-uniformity. The drive TFT has to be stable with minimal degradation and uniform wherein the TFTs in the display panel are matched. However, gate bias stress over time may shift the threshold voltage and mobility of the TFTs. To handle this, alternate pixel circuits have been proposed that utilize multiple TFTs to do circuit compensation of threshold voltage shifts. Such circuits may utilize three to more than six TFT pixel circuits that can compensate for the threshold voltage shift and/or variation. However, these circuits do not account for the mobility shift and/or variation.

In another approach, a current signal may be utilized at the data column lines to set the state at the individual pixels instead of using a voltage signal to control the state of the individual pixels. For a conventional 1T-1C liquid-crystal display (LCD) and 2T-1C OLED pixel circuits, the data column lines are operated with voltage data signals.

Some approaches to solving the threshold and mobility degradation and/or variation of the drive TFT involve applying current data signal to the column lines. This approach is often referred to as current programming. In these approaches a fixed current level may be applied through the drive TFT of the selected pixels in the program row. The storage capacitor will charge up to the specified gate bias of the drive TFT in order to achieve a predetermined current level. However, one of the challenges for pixel circuits with current-programming driving schemes is the charging time for low data currents involved with a low pixel brightness setting. The data current has to charge all the parasitic interconnect capacitances as it charges the storage capacitor. Low data current will take longer to charge, which may be difficult to do within a short row program time. As display sizes increase, the row program time decreases, but interconnect capacitance is larger. Thus, there may not be enough time to provide a full charge.

Most of the solutions to the low data current charging issue involve using some form of current scaling, where the data program current is higher than the actual current at the drive TFT. One such method is to use dimensional scaling of TFTs. Suppose a display has TFT "A" and TFT "B," where TFT "B" is the drive TFT connected to the OLED and it has a lower width to length (W/L) ratio than TFT "A". During the row program time, the data programming current runs through TFT "A" and charges the storage capacitor that is tied to gates of both TFT "A" and TFT "B." Therefore the drive TFT "B" that is connected to the OLED will operate a current that is scaled by its lower W/L ratio. This pixel circuit will only work as long as TFT "A" and "B" are matched, which can be assumed since they are in close proximity to each other. However, they may not degrade at equal rates since TFT "B" is operated for a longer time than TFT "A" and is subjected to lower currents. Therefore, such a pixel circuit will only work for backplanes that have non-uniform but stable VT and mobility. Another issue with dimensional scaling is that scaling current by 10× for example may be difficult given the constraints of the pixel area allowed for higher resolution displays.

DESCRIPTION OF THE DRAWING FIGURES

Claimed subject matter is particularly pointed out and distinctly claimed in the concluding portion of the specification. However, such subject matter may be understood by reference to the following detailed description when read with the accompanying drawings in which:

Figure 1:
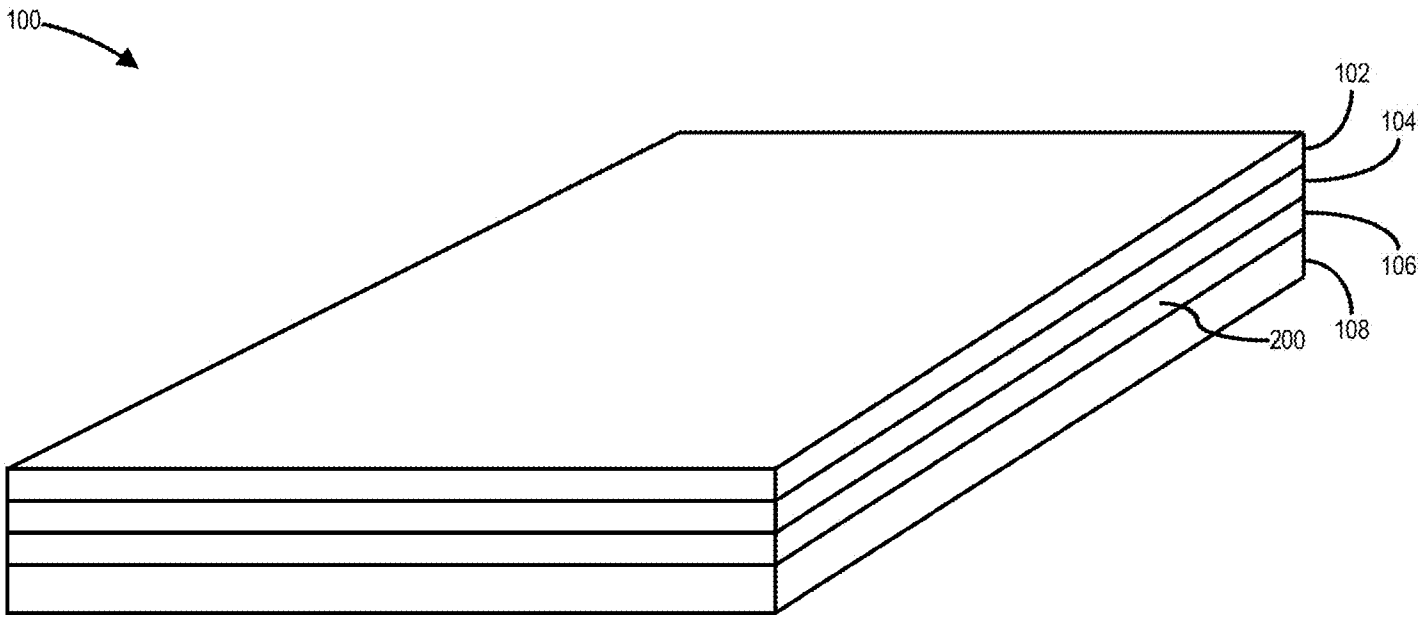
FIG. 1 is a diagram of a thin film transistor (TFT) backplane for a current-driven display in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or circuits have not been described in detail.

In the following description and/or claims, the terms coupled and/or connected, along with their derivatives, may be used. In particular embodiments, connected may be used to indicate that two or more elements are in direct physical and/or electrical contact with each other. Coupled may mean that two or more elements are in direct physical and/or electrical contact. However, coupled may also mean that two or more elements may not be in direct contact with each other, but yet may still cooperate and/or interact with each other. For example, "coupled" may mean that two or more elements do not contact each other but are indirectly joined together via another element or intermediate elements. Finally, the terms "on," "overlying," and "over" may be used in the following description and claims. "On," "overlying," and "over" may be used to indicate that two or more elements are in direct physical contact with each other. However, "over" may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect. In the following description and/or claims, the terms "comprise" and "include," along with their derivatives, may be used and are intended as synonyms for each other.

Referring now to FIG. 1, a diagram of a thin film transistor backplane for a current-driven display in accordance with one or more embodiments will be discussed. As shown in FIG. 1, a backplane 100 may be utilized for a current-driven display comprising electro-optical elements, for example organic light-emitting diode (OLED) and/or metal-oxide light-emitting diode (MOLED) elements. Such a backplane 100 may comprise a cathode layer 102, one or more organic active layers 104, a thin-film transistor (TFT) array 106, and a substrate 108. The TFT array 108 provides the drive and control elements to drive the electro-optical elements of the organic active layer 104 in order to produce a viewable image. When the control elements of the TFT array 106 are driven positive across an OLED of the organic layer 104 with respect to the voltage on the cathode layer 102, the pixel element of the organic layer 104 will emit light, the intensity of which being determined by the current applied to the OLED via a drive TFT. In accordance with one or more embodiments, the TFT array 106 of backplane 100 may include a pixel circuit 200, or two or more pixel circuits in an array, that is capable of setting when the drive TFT turns "ON" or "OFF" and which may be capable of maintaining and/or compensating for TFT degradation as will be discussed in further detail with respect to FIG. 2, below.

Figure 2:
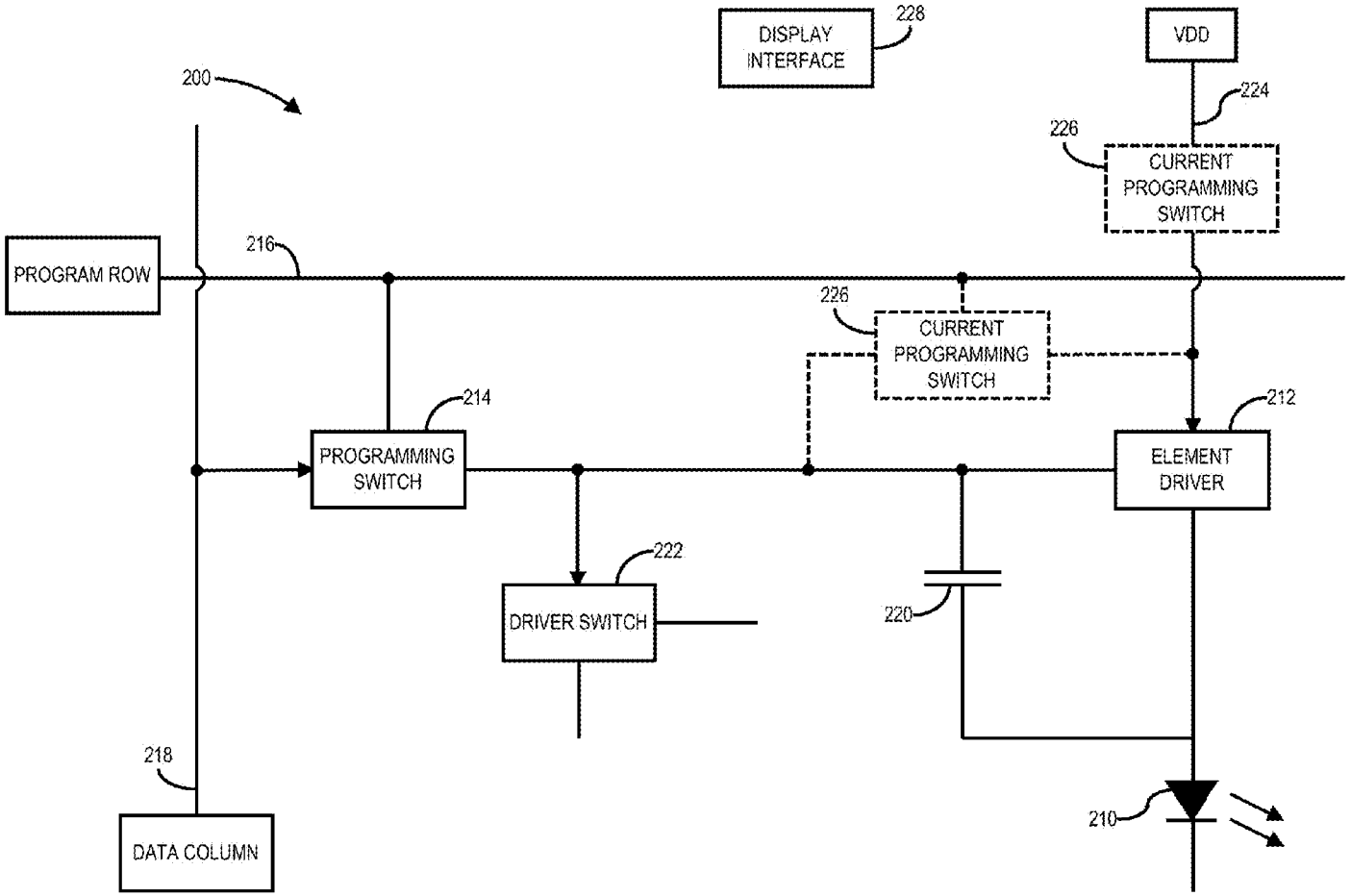
FIG. 2 is a pixel circuit having a switching component capable to set when a drive thin film transistor (TFT) turns on or off in accordance with one or more embodiments.

Referring now to FIG. 2, a pixel circuit having a switching component capable to set when a drive thin film transistor (TFT) turns on or off in accordance with one or more embodiments will be discussed. As shown in FIG. 2, pixel circuit 200 may comprise an electro-optical element such as OLED 210. Although an OLED 210 is shown for purposes of example herein, it is noted that any type of current-driven electro-optical elements may be utilized, and the scope of the claimed subject matter is not limited in this respect. Pixel circuit 200 in a two transistor, one capacitor (2T-1C) arrangement may comprise an element driver 212 coupled to the OLED 210 and a programming switch 214 coupled to the element driver 212. The OLED 210 is shown here to be connected after the element driver 212, but alternate hookup for OLED 210 can be used, such as OLED 210 connected before the element driver 212 and closer to the power supply rail 224 (VDD), and the scope of the claimed subject matter is not limited in this respect. The particular embodiment shown in FIG. 2 is for data voltage programming, where data voltages are applied to the data columns 218 to be stored at each pixel circuit 200 in an array. However, alternate configurations can make this operate with current programming, for example using one or more optional current programming switches 226, where data currents are applied to the data columns 218 to stored voltages at each pixel circuit 200 in an array. In the current programming embodiments where current programming switches 226 are employed, the power supply rail 224 is separated from the element driver 212 by a current programming switch 226 so that the programming current will be the only current running through element driver 212 during the row program time when the programming switch 214 is on and a data current signal is applied at data columns 218. In voltage programming embodiments, current programming switches 226 are not present in circuit 200, and the power supply rail 224 is connected to the element driver 212. Other configurations may be used depending on the method of data programming the pixel circuits, whether by voltage or current signals, and the scope of the claimed subject matter is not limited in this respect. Programming switch 214 and element driver 212 may comprise thin-film transistors (TFTs), which may be fabricated as metal-oxide-semiconductor field-effect transistor (MOSFET) devices having gate, drain and source electrodes. However, other types of devices may be utilized, and the scope of the claimed subject matter is not limited in this respect. A program row line 216 provides a voltage to turn on the programming switch 214, a data column 218 provides a data voltage, and a power supply rail 224 (VDD) provides a power supply voltage that is applied to OLED 210 via element driver 212 to allow a drive current to flow through OLED 210 when OLED is switched "ON". A storage capacitor 220 is coupled to the drive element 212 and the OLED 210. In operation, the programming switch 214 turns on during programming time for the single row as controlled by program row line 216, and the data voltage is applied at the data column line 218 to set the storage capacitor 220 coupled between element driver 212 and OLED 210 to a particular voltage. When the switch TFT is turned "OFF", the next program row (not shown) is turned "ON" and programmed During a row program time, the storage capacitor 220 maintains the data voltage at element driver 212. This data voltage sets a bias voltage such as a gate bias for the element driver 212, and the bias voltage at element driver 212 in turn sets the drive current applied through OED 210. In one or more embodiments, a display interface 228 may be coupled to pixel circuit 200 to provide the video signals that drive pixel circuit 200. In some embodiments, display interface 228 may comprise a wireless display interface such as Intel® Wireless Display (WiDi) technology to couple a display in which pixel circuit is utilized via a wireless link. Display interface 228 may operate via any wired or wireless display technology, and the scope of the claimed subject matter is not limited in these respects.

In one or more embodiments, pixel circuit 200 may include a driver switch 222 that is capable of controlling when element driver 212 is "ON" or "OFF" by controlling the voltage at the storage capacitor 220. Such a driver switch 222 may be provided in the pixel circuit 200 for each pixel of backplane 100 to provide the ability to set when a respective element driver 212 turns "ON" or "OFF". In this arrangement, pulse-width modulation may be applied at each respective pixel to control when a given OLED 210 is turned "ON" or "OFF" and for how long. In one embodiment, utilizing a driver switch 222 allows operation of the pixel circuit 200 using a current-programming driving scheme with the current programming switch 226. For high data current levels, standard current programming is used, but for lower data current levels, where parasitic capacitance charging becomes an issue, a fixed programming current level is used. To achieve currents below this fixed programming current, pulse width modulation of the bias voltage at element driver 212 with driver switch 222 is utilized. This will effectively set a lower current applied to OLED 210 for the fixed programming current. Furthermore, utilization of driver switch 222 allows the pixel circuit 200 to only involve compensation for the circuit degrading at one operation state and current level. If the pixel circuit 200 always operates the element driver 212 and OLED 210 at a fixed drive current level, all or nearly all of the TFTs of the element drivers 212 in a given row may be compensated and/or calibrated together to that fixed current level. In addition, since the driver switch 222 can be responsible for turning "OFF" and modulating the element driver 212, the storage capacitor 220 may be programmed with whichever programming methods of current and/or voltage signals at data columns 218, and the scope of the claimed subject matter is not limited in this respect. An example embodiment of pixel circuit 200 is shown in and described with respect to FIG. 3, below.

Figure 3:
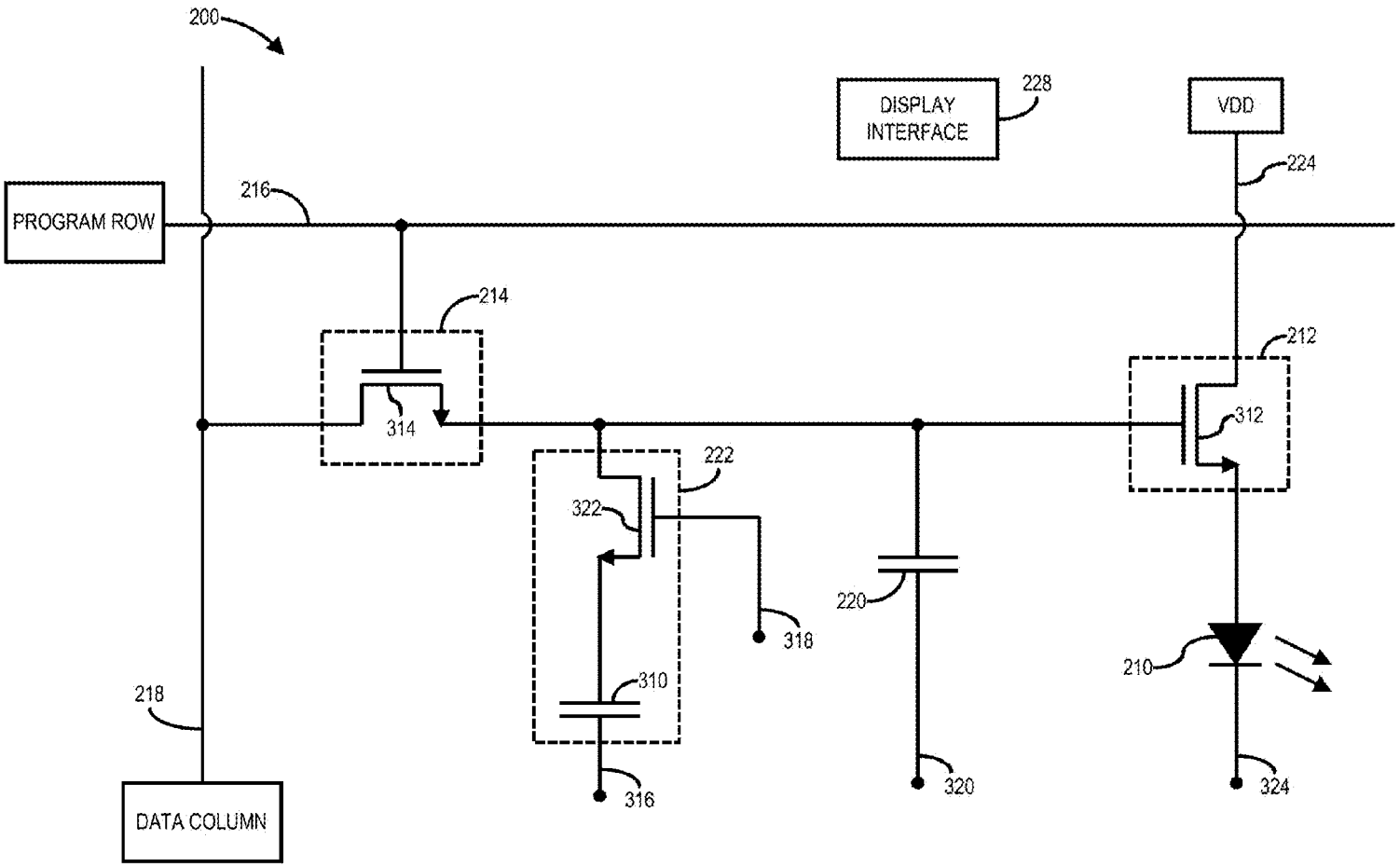
FIG. 3 is one embodiment of the pixel circuit of FIG. 2 in accordance with one or more embodiments.

Referring now to FIG. 3, one embodiment of the pixel circuit of FIG. 2 in accordance with one or more embodiments will be discussed. As shown in FIG. 3, pixel circuit 200 may comprise the elements of pixel circuit 200 of FIG. 2 wherein element driver 212 comprises a drive TFT 312, programming switch 214 comprises a program switch TFT 314, and driver switch 222 comprises drive switch TFT 322 coupled in series with drive switch capacitor 310. The voltage stored at drive switch capacitor 310 will determine when the drive switch TFT 322 turns "ON". When the drive switch TFT 322 turns "ON", the storage capacitor 220 and drive switch capacitor 310 will be shorted together, which consequently will switch the state of the drive TFT 312 to "ON" or "OFF". The capacitance of the drive switch capacitor 310 ideally should be greater than the capacitance of the storage capacitor 220 such that when shorted together the potential of the storage capacitor 220 changes enough to turn the drive TFT 312 to a different "OFF" state. While the drive switch TFT 322 is "OFF", the voltage at the storage capacitor 220 is setting the current of OLED 210. In general, the drive switch TFT 322 is "OFF" most of the time except when the drive switch TFT 322 operates to switch the state of the drive TFT 312. Therefore, electrical stress across the drive switch TFT 322 is relatively minimal compared to the electrical stress of the drive TFT 312 since the drive TFT 312 may remain "ON" during a whole frame time. It should be noted that any one or more of the device nodes, such as node 316, node 318, node 320 or node 324, may have various connections to other nodes or bus lines depending on how pixel circuit 200 is driven with various waveforms, and the scope of the claimed subject matter is not limited in this respect. In general, a bus line is a communication line that used to couple electrical components in a circuit, although the scope of the claimed subject matter is not limited in this respect. This particular embodiment uses voltage programming at the data column lines 218. An alternative embodiment of pixel circuit 200 is shown in and described with respect to FIG. 4, below.

Figure 4:
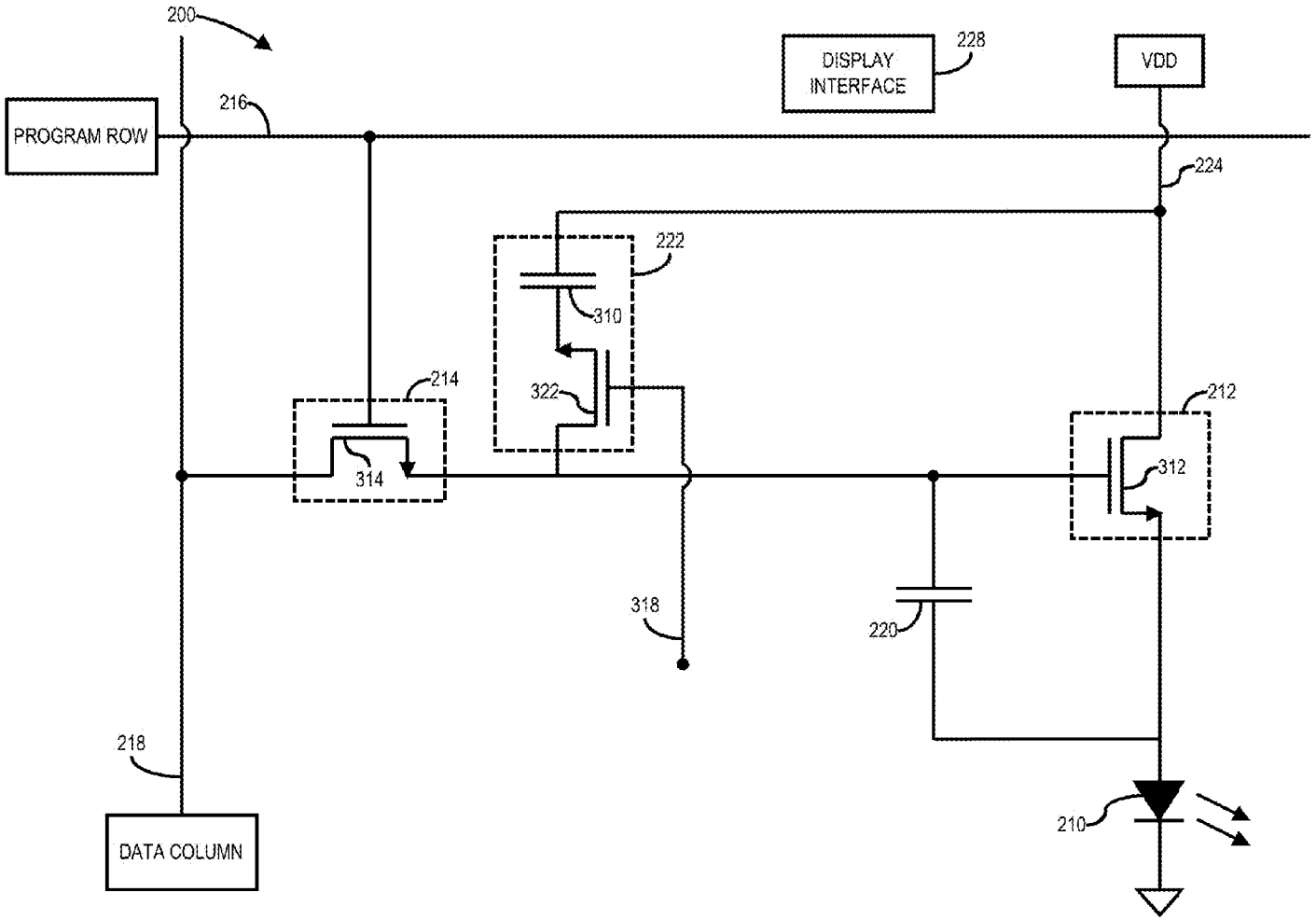
FIG. 4 is another embodiment of the pixel circuit of FIG. 2 in accordance with one or more embodiments.

Referring now to FIG. 4, another embodiment of the pixel circuit of FIG. 2 in accordance with one or more embodiments will be discussed. As shown in FIG. 4, pixel circuit 200 may comprise essentially the same elements of FIG. 3, except that the drive switch TFT 322 and the drive switch capacitor 310 are connected to different nodes. In the arrangement of FIG. 4, the gate 318 of the drive switch TFT 322 is connected to the next program row in an array of pixel circuits 200, for example program row n+1, in order to reduce the number of bus lines in the array. Alternatively, the gates 318 of the drive switch TFT 322 in an array of pixel circuits 200 may be connected to their own bus line that runs parallel to the program row lines 216 in the array. Furthermore, in the embodiment shown in FIG. 4, one electrode of the switch capacitor is connected to the power supply rail 224 also to reduce the number of bus lines in the array. It is noted that the circuits shown in FIG. 3 and FIG. 4 are merely example embodiments of the pixel circuit 200 of FIG. 2 wherein other variations of the pixel circuit 200 may be realized, and the scope of the claimed subject matter is not limited in this respect. In the embodiment shown in FIG. 4, the drive switch capacitor 310 may share its bus with the power supply rail 224, and optionally the gate node 318 of the drive switch TFT 322 may be coupled to the next program row or to its own switch row, and the scope of the claimed subject matter is not limited in this respect. An example array of pixel circuits is shown in and described with respect to FIG. 5, below.

Figure 5:
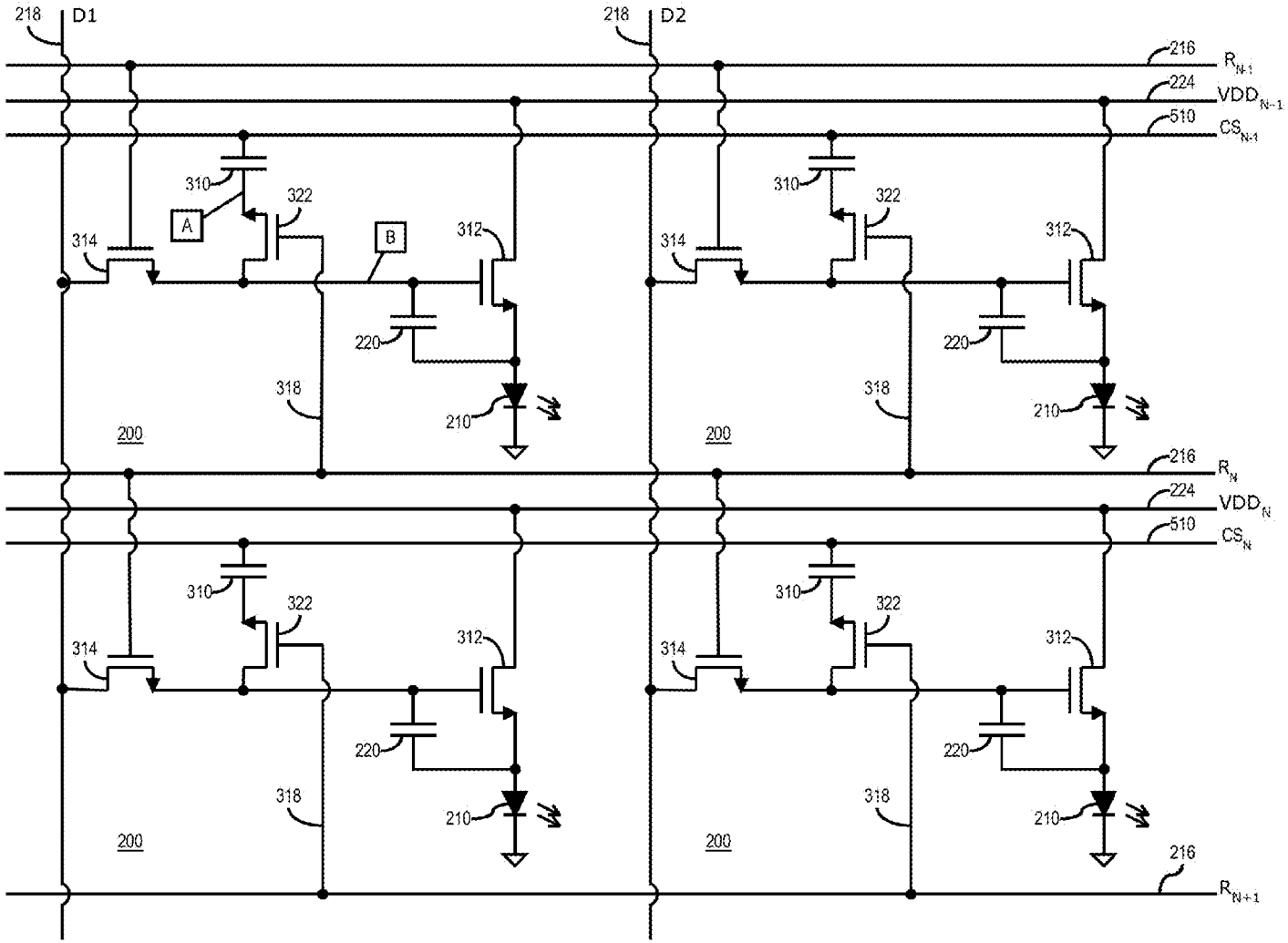
FIG. 5 is an example 2×2 section of an array of the pixel circuit of FIG. 2 using the circuit of FIG. 3 in accordance with one or more embodiments.

Referring now to FIG. 5, an example section of an array of the pixel circuit of FIG. 2 using the circuit of FIG. 3 in accordance with one or more embodiments will be discussed. FIG. 5 shows a 2×2 section of an array of pixel circuits 200 for example the pixel circuits 200 shown in particular in FIG. 3. Although a 2×2 section of an array is shown and described for purposes of example, other array sizes may be utilized in practice for the TFT array 106 of FIG. 1, and the scope of the claimed subject matter is not limited in this respect. As shown in FIG. 5, program switch TFT 314 turns on during row program times to store data voltages into the capacitors. Drive TFT 312 and storage capacitor 220 set the current through OLED 210, and drive switch TFT 322 is responsible for pulse-width modulation of the current through OLED 210. The voltage on drive switch capacitor 310 sets the point in time when the terminals A of drive switch capacitor 310 and B of storage capacitor 220 short to the same potential at which point the drive TFT 312 will be turned "OFF". The drive current through OLED 210 may therefore be pulse-width modulated "ON" or "OFF" by controlling the voltage on drive switch capacitor 310 via drive switch TFT 322. In the arrangement shown in FIG. 5, the gate electrode 318 of drive switch TFT 322 for row=$R_{N-1}$ may be coupled to the program row line 216 of row=$R_N$. Likewise, the drive switch capacitor 310 may be coupled to a control switch bus line $CS_{N-1}$ for row=$R_{N-1}$. Such an arrangement provides the drive signals to allow operation of pixel circuit 200 to be controlled in a desired manner. Either the gate electrode 318 of drive switch TFT 322 and/or the control switch bus line $CS_{N-1}$ may be modulated to control at which point in time the drive switch TFT 322 is turned "ON" and shorts the potential between the drive switch capacitor 310 terminal A and storage capacitor 220 terminal B. When the drive switch TFT 322 is turned "ON", charge transfer occurs between the drive switch capacitor 310 and the storage capacitor 220. The capacitance of the drive switch capacitor 310 should be large enough such that the potential at terminal B of the storage capacitor 220 is reduced to turn "OFF" the drive TFT 312. An illustration of example waveforms to drive the array of FIG. 5 is shown in and described with respect to FIG. 6, below.

Figure 6:
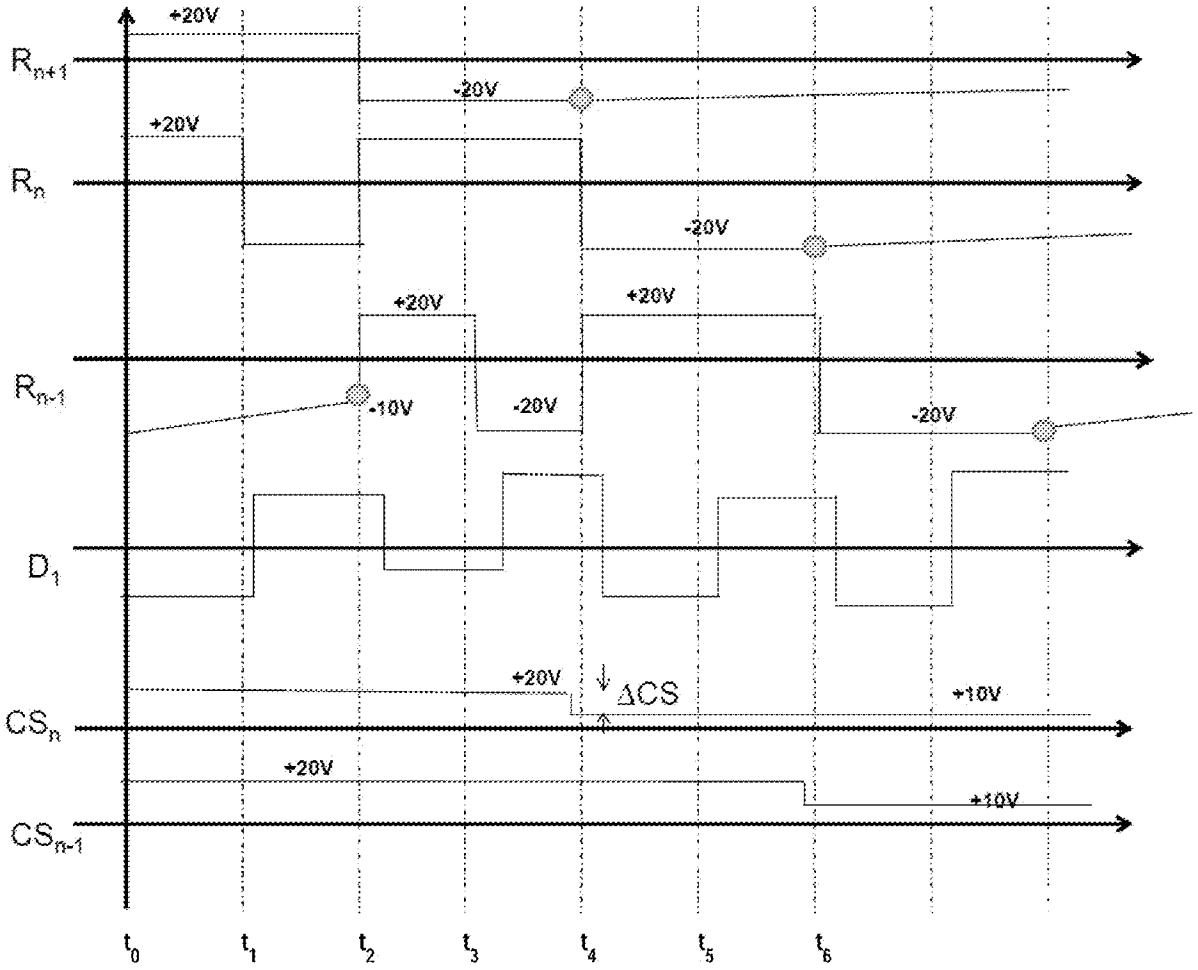
FIG. 6 is an illustration of example waveforms to drive the array of FIG. 5 in accordance with one or more embodiments.

Referring now to FIG. 6, an illustration of example waveforms to drive the array of FIG. 5 in accordance with one or more embodiments will be discussed. In the embodiment shown in FIG. 6, the sequential programming occurs from the "bottom" or "last" row and works its way up to the "top" or "first" row. This is because the gates 318 of the drive switch TFTs 322 of program row=$R_N$ are tied to the program row line 216 for program row=$R_{N-1}$ as shown in FIG. 5. If the gates 318 of the drive switch TFTs 322 are coupled to a dedicated bus line (not shown), then the drive waveform will be simpler. As shown in FIG. 6, the ramp voltage for $R_{N-1}$, $R_N$, and $R_{N+1}$ is specifically for the gates of the drive switch TFTs 322. Depending on the voltage stored in the drive switch capacitors 310, the drive switch TFTs 322 will turn "ON" and force the terminals A of the drive switch capacitors 310 and B of the storage capacitors 220 to be at the same potential. Since the voltage of the drive switch capacitors 310 is always less than zero and has sufficiently larger capacitance than storage capacitor 220 in this embodiment, after charge transfer occurs when the two terminals A and B are shorted after turning on drive switch TFT 322, the voltage at the storage capacitors 220 will be less than zero and turn "OFF" the drive TFT 312. In this particular embodiment, the data voltages stored at drive switch capacitors 310 do not exceed zero, but other embodiments can have data voltages greater than zero so long as the OLED is switched from one state "ON" to another state "OFF." This particular pixel circuit uses data voltage programming where data voltages are stored to each row of pixels in two steps. However, other embodiments can utilize current programming as well and the scope of the claimed subject matter is not limited in this respect. In the first step, data voltage is stored in the switch capacitors 310. In the second step, the data voltage is stored in the storage capacitors 220. FIG. 6 is broken up by dashed lines in each of the different voltage programming steps. In the first group from $t_0$ to $t_1$, $R_{N+1}$ and $R_N$ are turned high to turn on the program switch TFT 314 and drive switch TFT 322 in Row N. In this embodiment, 20V is used as the high voltage to turn on the program switch, but other actual voltage levels can be used so long as the TFTs operate as intended and the scope of the claimed subject matter is not limited in this respect. While $R_{N+1}$ and $R_N$ are turned high, the voltage at D1 will be stored in the drive switch capacitor 310 of that pixel in Row N. This is the first voltage programming step for row N. From time $t_1$ to $t_2$, $R_N$ is switched low to turn "OFF" the program switch TFT 314 of row N. $R_{N-1}$ is still high because now the voltage at D1 will be stored in the storage capacitor 220 of the next row $R_{N+1}$ (not shown). This is the second and last voltage programming step for row N+1. After this, $R_{N+1}$ should no longer turn "ON" program switch TFT 314 for Row N+1 until the next frame. From $t_2$ to $t_3$, $R_N$ is switched high again while $R_{N+1}$ is turned "OFF" and $R_{N-1}$ is turned "ON". During $t_2$ to $t_3$, the program switch TFT 314 and drive switch TFT 322 are turned "ON" for row N−1. Similarly to the first block from $t_0$ to $t_1$, the voltage at D1 will be stored in the drive switch capacitor 310 of that pixel in Row N−1. This is the first voltage programming step for Row N−1. The next time block from $t_3$ to $t_4$ is the second voltage programming step for row N. $R_N$ is high to turn "ON" program switch TFT 314 for Row N. $R_{N+1}$ is kept low and keeps drive switch TFT 322 of Row N "OFF". A voltage is already stored in the drive switch capacitor 310 for Row N. The voltage at D1 will now be stored at the storage capacitor 220 of Row N. This is the second and last voltage programming step for Row N where there should be desired data voltages stored in both the storage capacitor 220 and drive switch capacitor 310 for Row N. In the next time block from $t_4$ to $t_5$, a voltage ramp is now applied at $R_{N+1}$. The purpose of the voltage ramp at $R_{N+1}$ is to ramp the voltage at the gate electrode 318 of drive switch TFT 322 of Row N. Once the potential at the gate 318 of Row N exceeds the potential at terminal A of the drive switch capacitor 310 of Row N by the threshold voltage of the drive switch TFT 322 of Row N, the drive switch TFT 322 of Row N will be turned "ON". At this point, drive switch capacitor 310 and storage capacitor 220 will be shorted together. This shorting of potentials should result in a lowering of potential at storage capacitor 220 which is connected to the gate of the driver TFT 312 which in turn should cause the OLED to be turned "OFF", before which it should have been "ON". The control switch bus line $CS_N$ for Row N is responsible for dropping the potential at drive switch capacitor 310 after the data voltage is transferred from the data column lines 218. This lowering in potential allows the ramp voltage waveform at the gate 318 of the drive switch TFT 322 to be able to ramp the potential at gate 318 to be greater than the potential at terminal A of the drive switch capacitor 310 and at the same time, never have to ramp to a value that will inadvertently turn on the program switch TFTs 314. Therefore, there is a delta between the potential at drive switch capacitor 310 programmed by the data column lines 218 and the actual final desired potential at the storage capacitors 310 after the voltage drop at the control switch bus lines 510. This delta is determined by the amount of voltage drop at the control switch bus lines 510 after data voltage programming at the data column lines 218.

Figure 7:
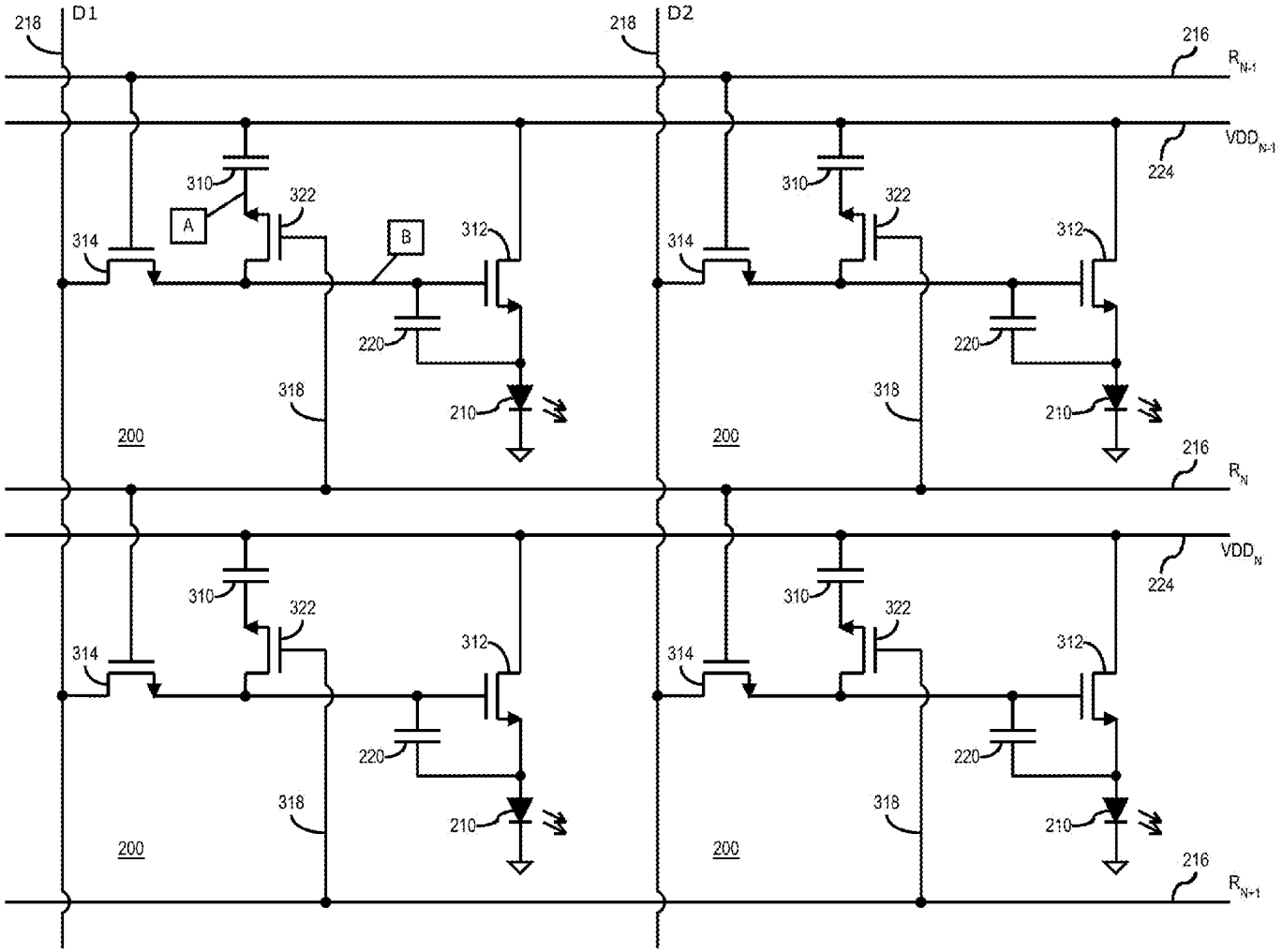
FIG. 7 is an example 2×2 section of an array of the pixel circuit of FIG. 2 using the circuit of FIG. 4 in accordance with one or more embodiments.

Referring now to FIG. 7, an example 2×2 section of an array of the pixel circuit of FIG. 2 using the circuit of FIG. 4 in accordance with one or more embodiments will be discussed. The layout and operation of the 2×2 array of pixel circuits 200 as shown in FIG. 7 are substantially similar to that of the 2×2 array of FIG. 5 except that in FIG. 7 the drive switch capacitors 310 are coupled to the power supply rails 224 instead of to their own bus lines 510 as shown in FIG. 5.

Figure 8:
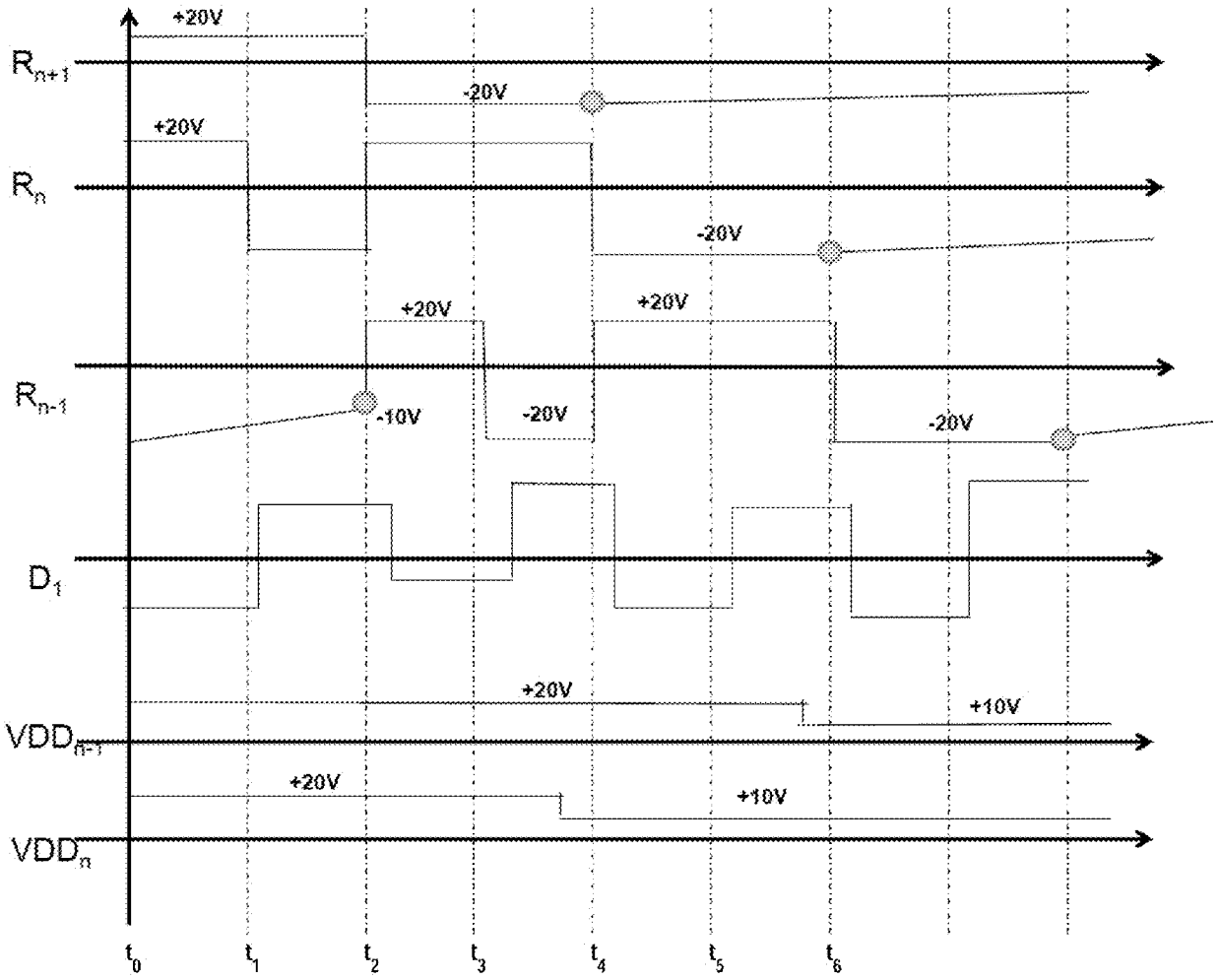
FIG. 8 is an illustration of example waveforms to drive the array of FIG. 7 in accordance with one or more embodiments.

Referring now to FIG. 8, an illustration of example waveforms to drive the array of FIG. 7 in accordance with one or more embodiments will be discussed. In the embodiment shown in FIG. 8, the sequential programming occurs from the "bottom" or "last" row and works its way up to the "top" or "first" row. This is because the gates 318 of the drive switch TFTs 322 of program row=$R_N$ are tied to the program row line 216 for program row=$R_{N+1}$ as shown in FIG. 7. If the gates 318 of the drive switch TFTs 322 are coupled to a dedicated bus line (not shown), then the drive waveform will be simpler. As shown in FIG. 8, the ramp voltage for $R_{N-1}$, $R_N$, and $R_{N+1}$ is specifically for the gates of the drive switch TFTs 322. Depending on the voltage stored in the drive switch capacitors 310, the drive switch TFTs 322 will turn "ON" and force the terminals A of the drive switch capacitors 310 and B of the storage capacitors 220 to be at the same potential. Since the voltage of the drive switch capacitors 310 is always less than zero and has sufficiently larger capacitance than storage capacitor 220 in this embodiment, after charge transfer occurs when the two terminals A and B are shorted after turning on drive switch TFT 322, the voltage at the storage capacitors 220 will be less than zero and turn "OFF" the drive TFT 312. In this particular embodiment, the data voltages stored at drive switch capacitors 310 do not exceed zero, but other embodiments can have data voltages greater than zero so long as the OLED is switched from one state "ON" to another state "OFF." This particular pixel circuit uses data voltage programming where data voltages are stored to each pixel circuit in two steps. However, other embodiments can utilize current programming as well and the scope of the claimed subject matter is not limited in this respect. In the first step, data voltage is stored in the switch capacitors 310. In the second step, the data voltage is stored in the storage capacitors 220. FIG. 8 is broken up by dashed lines in each of the different voltage programming steps. In the first group from $t_0$ to $t_1$, $R_{N+1}$ and $R_N$ are turned high to turn on the program switch TFT 314 and drive switch TFT 322 in Row N. In this embodiment, 20V is used as the high voltage to turn on the program switch, but other actual voltage levels can be used so long as the TFTs operate as intended and the scope of the claimed subject matter is not limited in this respect. While $R_{N+1}$ and $R_N$ are turned high, the voltage at D1 will be stored in the drive switch capacitor 310 of that pixel in Row N. This is the first voltage programming step for row N. From time $t_1$ to $t_2$, $R_N$ is switched low to turn "OFF" the program switch TFT 314 of row N. $R_{N+1}$ is still high because now the voltage at D1 will be stored in the storage capacitor 220 of the next row $R_{N+1}$ (not shown). This is the second and last voltage programming step for row N+1. After this, $R_{N+1}$ should no longer turn "ON" program switch TFT 314 for Row N+1 until the next frame. From $t_2$ to $t_3$, $R_N$ is switched high again while $R_{N+1}$ is turned "OFF" and $R_{N-1}$ is turned "ON". During $t_2$ to $t_3$, the program switch TFT 314 and drive switch TFT 322 are turned "ON" for row N−1. Similarly to the first block from $t_0$ to $t_1$, the voltage at D1 will be stored in the drive switch capacitor 310 of that pixel in Row N−1. This is the first voltage programming step for Row N−1. The next time block from $t_3$ to $t_4$ is the second voltage programming step for row N. $R_N$ is high to turn "ON" program switch TFT 314 for Row N. $R_{N+1}$ is kept low and keeps drive switch TFT 322 of Row N "OFF". A voltage is already stored in the drive switch capacitor 310 for Row N. The voltage at D1 will now be stored at the storage capacitor 220 of Row N. This is the second and last voltage programming step for Row N where there should be desired data voltages stored in both the storage capacitor 220 and drive switch capacitor 310 for Row N. In the next time block from $t_4$ to $t_5$, a voltage ramp is now applied at $R_{N+1}$. The purpose of the voltage ramp at $R_{N+1}$ is to ramp the voltage at the gate electrode 318 of drive switch TFT 322 of Row N. Once the potential at the gate 318 of Row N exceeds the potential at terminal A of the drive switch capacitor 310 of Row N by the threshold voltage of the drive switch TFT 322 of Row N, the drive switch TFT 322 of Row N will be turned "ON". At this point, drive switch capacitor 310 and storage capacitor 220 will be shorted together. This shorting of potentials should result in a lowering of potential at storage capacitor 220 which is connected to the gate of the driver TFT 312 which in turn should cause the OLED to be turned "OFF", before which it should have been "ON". FIG. 7 does not have control switch bus lines as in FIG. 5. Since the drive switch capacitor 310 are connected to the power supply 224, the power supply rows 224 are now responsible for dropping the potential at drive switch capacitor 310 after the data voltage is transferred from the data column lines 218. This lowering in potential allows the ramp voltage waveform at the gate 318 of the drive switch TFT 322 to be able to ramp the potential at gate 318 to be greater than the potential at terminal A of the drive switch capacitor 310 and at the same time, never have to ramp to a value that will inadvertently turn on the program switch TFTs 314. Therefore, there is a delta between the potential at drive switch capacitor 310 programmed by the data column lines 218 and the actual final desired potential at the storage capacitors 310 after the voltage drop at the voltage supply row 224. This delta is determined by the amount of voltage drop at the voltage supply rows 224 after data voltage programming at the data column lines 218.

Figure 9:
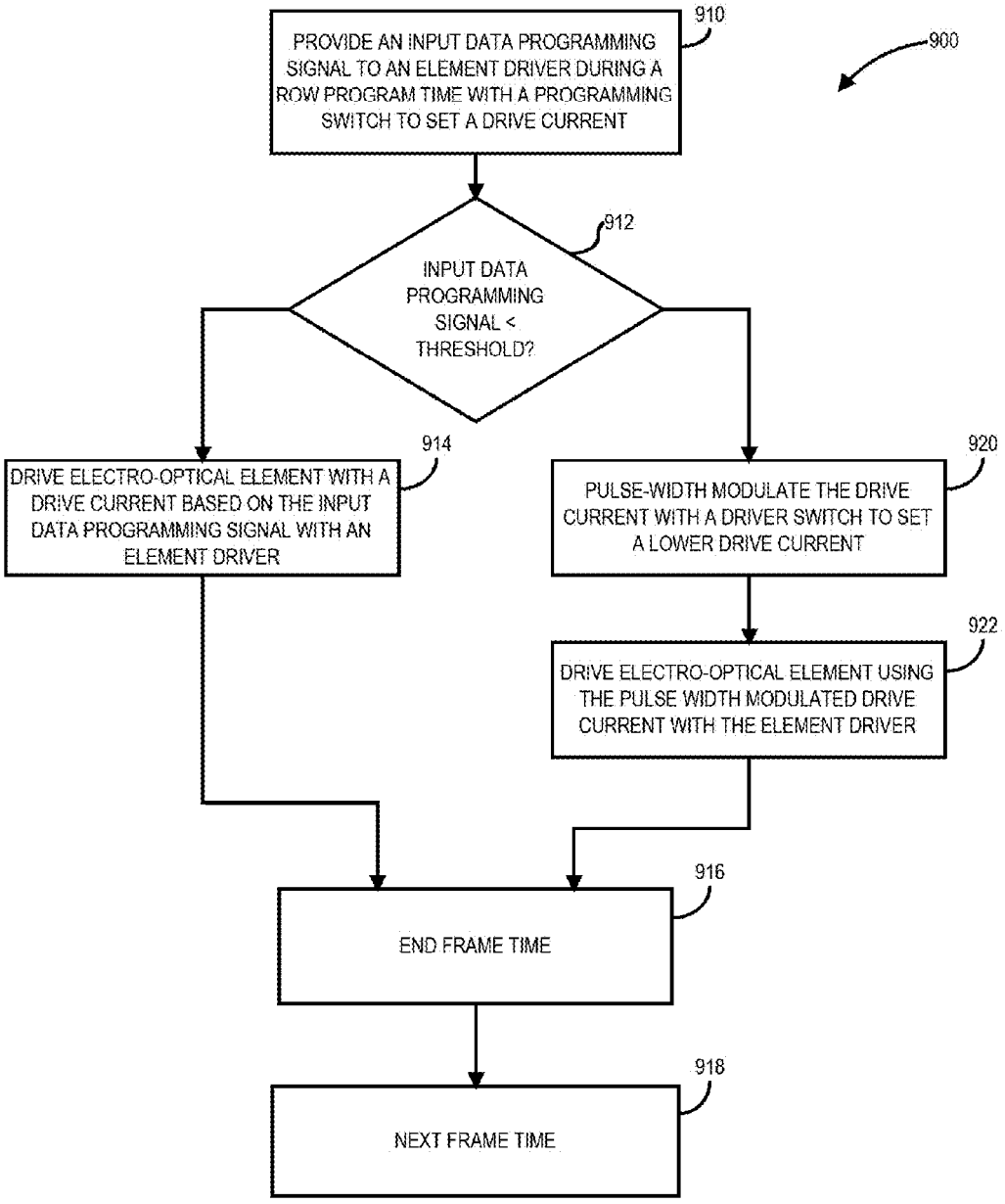
FIG. 9 is a flow diagram of a method to drive a thin film transistor in accordance with one or more embodiments.

Referring now to FIG. 9, a flow diagram of a method to drive a thin film transistor to drive an electro-optical element in accordance with one or more embodiments will be discussed. Although FIG. 9 shows one particular order of method 900 to drive a thin film transistor (TFT) to drive an electro-optical element, method 900 may include more or fewer blocks than shown in various other orders, and the scope of the claimed subject matter is not limited in this respect. At block 910, an input data programming signal is provided to element driver 212 during a row programming time with a programming switch 214 to set a drive current to drive an electro-optical element such as OLED 210. As determined at block 912, if the input data programming signal is not below a threshold and/or meets some chosen criteria, then the electro-optical element is driven at block 914 with a drive current with the element drive 212 wherein the drive current is based on the input data programming signal (voltage or current). Otherwise, if the input data programming signal is below a threshold and/or does not meet some chosen criteria as determined at block 912, the drive current is pulse-width modulated at block 920 with a driver switch 222 to set a lower drive current level using a fixed input programming data signal wherein pulse-width modulating the drive current results in a lower average drive current than would otherwise result without modulation. The electro-optical element 210 may then be driven at block 922 using the pulse-width modulated drive current using the element driver 212 to provide the lower drive current level. Block 914 or blocks 920 and 922 may be executed until an end of the frame time at block 916. At a next frame time at block 918, method 900 may continue at block 910. In one or more alternative embodiments, method 900 may operate without block 912 or block 914 such that pulse-width modulation is always employed to set the final drive current level according to the pulse-width modulation of the drive current initially set by the voltage and/or current programming. In one or more embodiments, method 900 may be implemented by an information handling system that utilizes the backplane 100 of FIG. 1 using pixel circuit 200 of FIG. 2 or an array of pixel circuits. Such an information handling is shown in and described with respect to FIG. 10, below.

Figure 10:
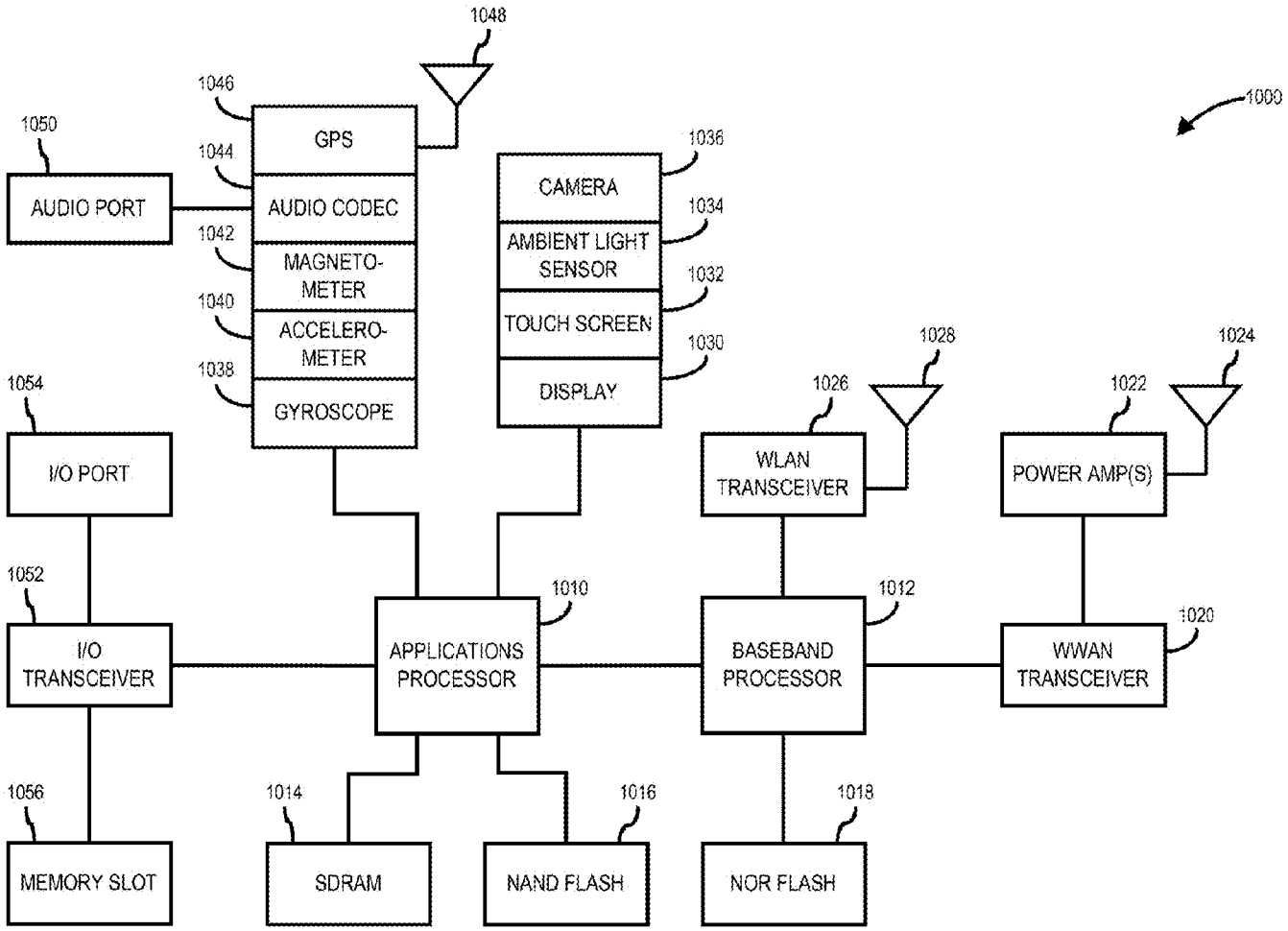
FIG. 10 is a block diagram of an information handling system capable of utilizing a thin film transistor backplane in a current-driven display in accordance with one or more embodiments.

Referring now to FIG. 10, a block diagram of an information handling system capable of utilizing a thin film transistor backplane in a current-driven display in accordance with one or more embodiments in accordance with one or more embodiments will be discussed. Information handling system 1000 of FIG. 10 may tangibly embody system that incorporates a display having a backplane 100 of FIG. 1 that includes pixel circuit 200 of FIG. 2, with greater or fewer components depending on the hardware specifications of the particular device. Although information handling system 1000 represents one example of several types of computing platforms, information handling system 1000 may include more or fewer elements and/or different arrangements of elements than shown in FIG. 10, and the scope of the claimed subject matter is not limited in these respects.

In one or more embodiments, information handling system 1000 may include an applications processor 1010 and a baseband processor 1012. Applications processor 1010 may be utilized as a general-purpose processor to run applications and the various subsystems for information handling system 1000. Applications processor 1010 may include a single core or alternatively may include multiple processing cores wherein one or more of the cores may comprise a digital signal processor or digital signal processing (DSP) core. Furthermore, applications processor 1010 may include a graphics processor or coprocessor disposed on the same chip, or alternatively a graphics processor coupled to applications processor 1010 may comprise a separate, discrete graphics chip. Applications processor 1010 may include on board memory such as cache memory, and further may be coupled to external memory devices such as synchronous dynamic random access memory (SDRAM) 1014 for storing and/or executing applications during operation, and NAND flash 1016 for storing applications and/or data even when information handling system 1000 is powered off. In one or more embodiments, instructions to operate or configure the information handling system 1000 and/or any of its components or subsystems to operate in a manner as described herein may be stored on a non-transitory article of manufacture comprising a storage medium. In one or more embodiments, the storage medium may comprise any of the memory devices shown in and described herein, although the scope of the claimed subject matter is not limited in this respect. Baseband processor 1012 may control the broadband radio functions for information handling system 1000. Baseband processor 1012 may store code for controlling such broadband radio functions in a NOR flash 1018. Baseband processor 1012 controls a wireless wide area network (WWAN) transceiver 1020 which is used for modulating and/or demodulating broadband network signals, for example for communicating via a 3GPP LTE or LTE-Advanced network or the like.

In general, WWAN transceiver 1020 may operate according to any one or more of the following radio communication technologies and/or standards including but not limited to: a Global System for Mobile Communications (GSM) radio communication technology, a General Packet Radio Service (GPRS) radio communication technology, an Enhanced Data Rates for GSM Evolution (EDGE) radio communication technology, and/or a Third Generation Partnership Project (3GPP) radio communication technology, for example Universal Mobile Telecommunications System (UMTS), Freedom of Multimedia Access (FOMA), 3GPP Long Term Evolution (LTE), 3GPP Long Term Evolution Advanced (LTE Advanced), Code division multiple access 2000 (CDMA2000), Cellular Digital Packet Data (CDPD), Mobitex, Third Generation (3G), Circuit Switched Data (CSD), High-Speed Circuit-Switched Data (HSCSD), Universal Mobile Telecommunications System (Third Generation) (UMTS (3G)), Wideband Code Division Multiple Access (Universal Mobile Telecommunications System) (W-CDMA (UMTS)), High Speed Packet Access (HSPA), High-Speed Downlink Packet Access (HSDPA), High-Speed Uplink Packet Access (HSUPA), High Speed Packet Access Plus (HSPA+), Universal Mobile Telecommunications System-Time-Division Duplex (UMTS-TDD), Time Division-Code Division Multiple Access (TD-CDMA), Time Division-Synchronous Code Division Multiple Access (TD-CDMA), 3rd Generation Partnership Project Release 8 (Pre-4th Generation) (3GPP Rel. 8 (Pre-4G)), UMTS Terrestrial Radio Access (UTRA), Evolved UMTS Terrestrial Radio Access (E-UTRA), Long Term Evolution Advanced (4th Generation) (LTE Advanced (4G)), cdmaOne (2G), Code division multiple access 2000 (Third generation) (CDMA2000 (3G)), Evolution-Data Optimized or Evolution-Data Only (EV-DO), Advanced Mobile Phone System (1st Generation) (AMPS (1G)), Total Access Communication System/Extended Total Access Communication System (TACS/ETACS), Digital AMPS (2nd Generation) (D-AMPS (2G)), Push-to-talk (PTT), Mobile Telephone System (MTS), Improved Mobile Telephone System (IMTS), Advanced Mobile Telephone System (AMTS), OLT (Norwegian for Offentlig Landmobil Telefoni, Public Land Mobile Telephony), MTD (Swedish abbreviation for Mobiltelefonisystem D, or Mobile telephony system D), Public Automated Land Mobile (Autotel/PALM), ARP (Finnish for Autoradiopuhelin, "car radio phone"), NMT (Nordic Mobile Telephony), High capacity version of NTT (Nippon Telegraph and Telephone) (Hicap), Cellular Digital Packet Data (CDPD), Mobitex, DataTAC, Integrated Digital Enhanced Network (iDEN), Personal Digital Cellular (PDC), Circuit Switched Data (CSD), Personal Handyphone System (PHS), Wideband Integrated Digital Enhanced Network (WiDEN), iBurst, Unlicensed Mobile Access (UMA), also referred to as also referred to as 3GPP Generic Access Network, or GAN standard), Zigbee, Bluetooth®, and/or general telemetry transceivers, and in general any type of RF circuit or RFI sensitive circuit. It should be noted that such standards may evolve over time, and/or new standards may be promulgated, and the scope of the claimed subject matter is not limited in this respect.

The WWAN transceiver 1020 couples to one or more power amps 1022 respectively coupled to one or more antennas 1024 for sending and receiving radio-frequency signals via the WWAN broadband network. The baseband processor 1012 also may control a wireless local area network (WLAN) transceiver 1026 coupled to one or more suitable antennas 1028 and which may be capable of communicating via a Wi-Fi, Bluetooth®, and/or an amplitude modulation (AM) or frequency modulation (FM) radio standard including an IEEE 802.11 a/b/g/n standard or the like. It should be noted that these are merely example implementations for applications processor 1010 and baseband processor 1012, and the scope of the claimed subject matter is not limited in these respects. For example, any one or more of SDRAM 1014, NAND flash 1016 and/or NOR flash 1018 may comprise other types of memory technology such as magnetic memory, chalcogenide memory, phase change memory, or ovonic memory, and the scope of the claimed subject matter is not limited in this respect.

In one or more embodiments, applications processor 610 may drive a display 1030 for displaying various information or data, and may further receive touch input from a user via a touch screen 1032 for example via a finger or a stylus. In one or more embodiments, display 1030 may include backplane 100 as shown in FIG. 1 and as discussed herein. An ambient light sensor 1034 may be utilized to detect an amount of ambient light in which information handling system 1000 is operating, for example to control a brightness or contrast value for display 1030 as a function of the intensity of ambient light detected by ambient light sensor 1034. One or more cameras 1036 may be utilized to capture images that are processed by applications processor 1010 and/or at least temporarily stored in NAND flash 1016. Furthermore, applications processor may couple to a gyroscope 1038, accelerometer 1040, magnetometer 1042, audio coder/decoder (CODEC) 1044, and/or global positioning system (GPS) controller 1046 coupled to an appropriate GPS antenna 1048, for detection of various environmental properties including location, movement, and/or orientation of information handling system 1000. Alternatively, controller 1046 may comprise a Global Navigation Satellite System (GNSS) controller. Audio CODEC 1044 may be coupled to one or more audio ports 1050 to provide microphone input and speaker outputs either via internal devices and/or via external devices coupled to information handling system via the audio ports 1050, for example via a headphone and microphone jack. In addition, applications processor 1010 may couple to one or more input/output (I/O) transceivers 1052 to couple to one or more I/O ports 1054 such as a universal serial bus (USB) port, a high-definition multimedia interface (HDMI) port, a serial port, and so on. Furthermore, one or more of the I/O transceivers 1052 may couple to one or more memory slots 1056 for optional removable memory such as secure digital (SD) card or a subscriber identity module (SIM) card, although the scope of the claimed subject matter is not limited in these respects.

Figure 11:
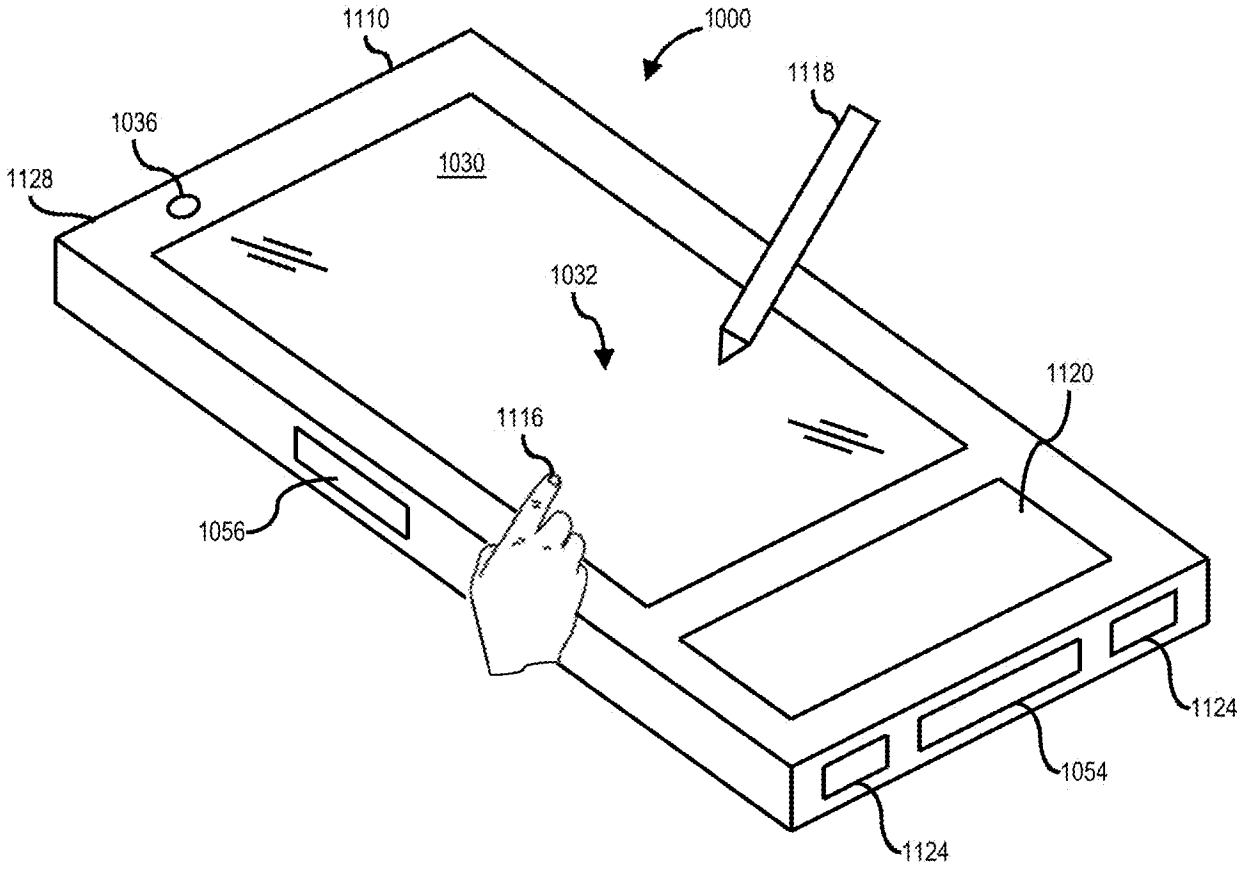
FIG. 11 is an isometric view of an information handling system of FIG. 10 that optionally may include a touch screen in accordance with one or more embodiments.

Referring now to FIG. 11, an isometric view of an information handling system of FIG. 10 that optionally may include a touch screen in accordance with one or more embodiments will be discussed. FIG. 11 shows an example implementation of information handling system 1000 of FIG. 10 tangibly embodied as a cellular telephone, smartphone, or tablet type device or the like. In one or more embodiments, the information handling system 1000 may include backplane 100 of FIG. 1, although the scope of the claimed subject matter is not limited in this respect. The information handling system 1000 may comprise a housing 1110 having a display 1030 which may include a touch screen 1032 for receiving tactile input control and commands via a finger 1116 of a user and/or a via stylus 1118 to control one or more applications processors 1010. The housing 1110 may house one or more components of information handling system 1000, for example one or more applications processors 1010, one or more of SDRAM 1014, NAND flash 1016, NOR flash 1018, baseband processor 1012, and/or WWAN transceiver 1020. The information handling system 1000 further may optionally include a physical actuator area 1120 which may comprise a keyboard or buttons for controlling information handling system via one or more buttons or switches. The information handling system 1000 may also include a memory port or slot 1056 for receiving non-volatile memory such as flash memory, for example in the form of a secure digital (SD) card or a subscriber identity module (SIM) card. Optionally, the information handling system 1000 may further include one or more speakers and/or microphones 1124 and a connection port 1054 for connecting the information handling system 600 to another electronic device, dock, display, battery charger, and so on. In addition, information handling system 1000 may include a headphone or speaker jack 1128 and one or more cameras 1036 on one or more sides of the housing 1110. It should be noted that the information handling system 1000 of FIG. 11 may include more or fewer elements than shown, in various arrangements, and the scope of the claimed subject matter is not limited in this respect.

In one example embodiment, a pixel circuit to drive an electro-optical element of a display backplane comprises an element driver coupled to the electro-optical element, a programming switch coupled to the element driver, and a driver switch coupled to the programming switch and the element driver. In a second example, the driver switch may comprise a drive switch transistor coupled with a drive switch capacitor. In a third example, the drive switch capacitor is coupled to its own bus line. In a fourth example, the drive switch capacitor is coupled to a power supply rail. In a fifth example, the drive switch transistor is coupled to its own bus line. In a sixth example, the drive switch transistor of one row is coupled to a program row line of a next row. In a seventh example, the pixel circuit further comprises a storage capacitor coupled to the element driver and the driver switch.

In another example embodiment, a backplane for a display, the backplane comprises a cathode layer, a thin film transistor (TFT) layer comprising an array of pixel circuits, and an organic active layer disposed adjacent to the TFT layer, wherein electro-optical elements of the organic active layer are coupled to a respective pixel circuit in the TFT layer. In a second example, the pixel circuits in the TFT layer comprise an element driver coupled to the electro-optical element, a programming switch coupled to the element driver, and a driver switch coupled to the programming switch and the element driver. In a third example the driver switch comprises a drive switch transistor coupled with a drive switch capacitor. In a fourth example the drive switch capacitor is coupled to its own bus line. In a fifth example, the drive switch capacitor is coupled to a power supply rail. In a sixth example, the drive switch transistor is coupled to its own bus line. In a seventh example, the drive switch transistor of one row is coupled to a program row line of a next row. In an eighth example, the backplane further comprises a storage capacitor coupled to the element driver and the driver switch.

In a further example embodiment, a method to drive an electro-optical element of a display backplane comprises providing an input data programming signal to an element driver during a row program time with a programming switch to set a drive current for the electro-optical element. If the input data programming signal is not below a threshold, the method involves driving the electro-optical element with the drive current set by the input data programming signal. If the input data programming signal is below the threshold, the method involves pulse-width modulating the drive current with a driver switch to set a lower driver current for the electro-optical element, and driving the electro-optical element with the pulse-width modulated drive current. In a second example, the pulse-with modulating comprises compensating for degradation of the element driver or the electro-optical element, or combinations thereof. In a third example, the providing comprises operating multiple element drivers in a row of element drivers to a predetermined current and calibrating one or more of the element drivers to the predetermined current level.

In yet another example embodiment, an article of manufacture comprises a non-transitory medium having instructions stored thereon to drive an electro-optical element of a display backplane, wherein the instructions, if executed, result in providing an input data programming signal to an element driver during a row program time with a programming switch to set a drive current for the electro-optical element, pulse-width modulating the drive current with a driver switch to set a driver current for the electro-optical element, and driving the electro-optical element with the pulse-width modulated drive current. In a second example, the pulse-with modulating comprises compensating for degradation of the element driver or the electro-optical element, or combinations thereof. In a third example, the providing comprises operating multiple element drivers in a row of element drivers to a predetermined current and calibrating one or more of the element drivers to the predetermined current level.

In yet a further example embodiment, an information handling system, comprises a display interface coupled to a backplane, the backplane comprising an organic layer comprising an array of electro-optical elements, and an array of pixel circuits to drive the electro-optical elements, wherein the pixel circuits comprise an element driver coupled to the electro-optical element, a programming switch coupled to the element driver, and a driver switch coupled to the programming switch and the element driver. In a second example the driver switch comprises a drive switch transistor coupled with a drive switch capacitor. In a third example, the display includes a touch screen to receive an input to control the processor.

In another further example of this embodiment, a display backplane comprises means for providing an input data programming signal to an element driver during a row program time with a programming switch to set a drive current for the electro-optical element, means for pulse-width modulating the drive current with a driver switch to set a driver current for the electro-optical element, and means for driving the electro-optical element with the pulse-width modulated drive current. In a second example of this embodiment, the means for pulse-with modulating comprises means for compensating for degradation of the element driver or the electro-optical element, or combinations thereof. In a third example of this embodiment, the means for providing comprises means for operating multiple element drivers in a row of element drivers to a predetermined current and means for calibrating one or more of the element drivers to the predetermined current level. In a fourth example of this embodiment, a machine readable medium includes code, when executed, to cause a machine to perform a method implemented by any one or more of the above means.

In an additional example embodiment, a machine-readable storage includes machine-readable instructions, when executed, to implement a method or realize an apparatus as claimed in any of the preceding example embodiments, or any of the embodiments described herein. Other embodiments further may be realized in addition to those discussed herein.

Although the claimed subject matter has been described with a certain degree of particularity, it should be recognized that elements thereof may be altered by persons skilled in the art without departing from the spirit and/or scope of claimed subject matter. It is believed that the subject matter pertaining to a thin film transistor display backplane and pixel circuit therefor and/or many of its attendant utilities will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed is:

1. A pixel circuit to drive an electro-optical element of a display backplane, comprising:

an element driver coupled to the electro-optical element and a first capacitor comprising a storage capacitor coupled to the element driver to maintain a voltage on the element driver;

a programming switch coupled to the element driver; and a driver switch coupled to the programming switch and the element driver, wherein the driver switch comprises a drive switch transistor coupled with a second capacitor comprising a drive switch capacitor and wherein the second capacitor comprising the drive switch capacitor is selectively coupled together with the first capacitor comprising the storage capacitor via operation of the drive switch transistor to change an operational state of the element;

wherein the driver switch operates to isolate the second capacitor from the first capacitor in a first mode of operation, and to couple the second capacitor with the first capacitor in a second mode of operation;

wherein the driver switch is capable of controlling when the element driver is turned on and turned off via a selected waveform applied to the drive switch transistor to drive the electro-optical element at a lower drive current set by the selected waveform which controls the coupling of the second capacitor with the first capacitor in the second mode of operation in response to an input programming signal being less than a threshold, and to otherwise drive the electro-optical element at a higher drive current via a voltage on the first capacitor comprising the storage capacitor wherein the second capacitor is isolated from the first capacitor in the first mode of operation.

2. A pixel circuit as claimed in claim 1, wherein the drive switch capacitor is coupled to its own bus line.

3. A pixel circuit as claimed in claim 1, wherein the drive switch capacitor is coupled to a power supply rail.

4. A pixel circuit as claimed in claim 1, wherein the drive switch transistor is coupled to its own bus line.

5. A pixel circuit as claimed in claim 1, wherein the drive switch transistor of one row is coupled to a program row line of a next row.

6. A pixel circuit as claimed in claim 1, further comprising a storage capacitor coupled to the element driver and the driver switch.

7. A backplane for a display, the backplane comprising:

a cathode layer;

a thin film transistor (TFT) layer comprising an array or pixel circuits; and an organic active layer disposed adjacent to the TFT layer, wherein electro-optical elements of the organic active layer are coupled to a respective pixel circuit in the TFT layer;

wherein the pixel circuits in the TFT layer comprise:

an element driver coupled to the electro-optical element and a first capacitor comprising a storage capacitor coupled to the element driver to maintain a voltage on the element driver;

a programming switch coupled to the element driver; and a driver switch coupled to the programming switch and the element driver, wherein the driver switch comprises a drive switch transistor coupled with a second capacitor comprising a drive switch capacitor and wherein the second capacitor comprising the drive switch capacitor is selectively coupled together with the first capacitor comprising the storage capacitor via operation of the drive switch transistor to change an operational state of the element driver;

wherein the driver switch operates to isolate the second capacitor from the first capacitor in a first mode of operation, and to couple the second capacitor with the first capacitor in a second mode of operation;

wherein the driver switch is capable of controlling when the element driver is turned on and turned off via a selected waveform applied to the drive switch transistor to drive the electro-optical element at a lower drive current set by the selected waveform which controls the coupling of the second capacitor with the first capacitor in the second mode of operation in response to an input programming signal being less than a threshold, and to otherwise drive the electro-optical element at a higher drive current via a voltage on the first capacitor comprising the storage capacitor wherein the second capacitor is isolated from the first capacitor in the first mode of operation.

8. A backplane as claimed in claim 7, wherein the drive switch capacitor is coupled to its own bus line.

9. A backplane as claimed in claim 7, wherein the drive switch capacitor is coupled to a power supply rail.

10. A backplane as claimed in claim 7, wherein the drive switch transistor is coupled to its own bus line.

11. A backplane as claimed in claim 7, wherein the drive switch transistor of one row is coupled to a program row line of a next row.

12. A backplane as claimed in claim 7, further comprising a storage capacitor coupled to the element driver and the driver switch.

13. A method to drive an electro-optical element of a display backplane, comprising:

providing an input data programming signal to an element driver during a row program time with a programming switch to set a drive current for the electro-optical element and to maintain a voltage on the element driver via a first capacitor comprising a storage capacitor;

if the input data programming signal is not below a threshold, driving the electro-optical element with the drive current set by the input data programming signal; and if the input data programming signal is below the threshold, pulse-width modulating the drive current with a driver switch to set a lower driver current for the electro-optical element, and driving the electro-optical element with the pulse-width modulated drive current, wherein the driver switch comprises a drive switch transistor coupled with a second capacitor comprising a drive switch capacitor and wherein the second capacitor comprising the drive switch capacitor is selectively coupled together with the first capacitor comprising the storage capacitor via pulse-width modulation of the drive switch transistor to change an operational state of the element driver;

wherein the driver switch operates to isolate the second capacitor from the first capacitor in a first mode of operation, and to couple the second capacitor with the first capacitor in a second mode of operation;

wherein the driver switch is capable of controlling when the element driver is turned on and turned off via a selected waveform applied to the drive switch transistor to drive the electro-optical element at a lower drive current set by the selected waveform which controls the coupling of the second capacitor with the first capacitor in the second mode of operation in response to an input programming signal being less than a threshold, and to otherwise drive the electro-optical element at a higher drive current via a voltage on the first capacitor comprising the storage capacitor wherein the second capacitor is isolated from the first capacitor in the first mode of operation.

14. A method as claimed in claim 13, wherein said pulse-with modulating comprises compensating for degradation of the element driver or the electro-optical element, or combinations thereof.

15. A method as claimed in claim 13, wherein said providing comprises operating multiple element drivers in a row of element drivers to a predetermined current and calibrating one or more of the element drivers to the predetermined current level.

16. An article of manufacture comprising a non-transitory medium having instructions stored thereon to drive an electro-optical element of a display backplane, wherein the instructions, if executed, result in:

providing an input data programming signal to an element driver during a row program time with a programming switch to set a drive current for the electro-optical element and to maintain a voltage on the element driver via a first capacitor comprising a storage capacitor;

pulse-width modulating the drive current with a driver switch to set a driver current for the electro-optical element; and driving the electro-optical element with the pulse-width modulated drive current;

wherein the driver switch comprises a drive switch transistor coupled with a second capacitor comprising a drive switch capacitor and wherein the second capacitor comprising the drive switch capacitor is selectively coupled together with the first capacitor comprising the storage capacitor via pulse-width modulation of the drive switch transistor to change an operational state of the element driver;

wherein the driver switch operates to isolate the second capacitor from the first capacitor in a first mode of operation, and to couple the second capacitor with the first capacitor in a second mode of operation;

wherein the driver switch is capable of controlling when the element driver is turned on and turned off via a selected waveform applied to the drive switch transistor to drive the electro-optical element at a lower drive current set by the selected waveform which controls the coupling of the second capacitor with the first capacitor in the second mode of operation in response to an input programming signal being less than a threshold, and to otherwise drive the electro-optical element at a higher drive current via a voltage on the first capacitor comprising the storage capacitor wherein the second capacitor is isolated from the first capacitor in the first mode of operation.

17. An article of manufacture as claimed in claim 16, wherein said pulse-with modulating comprises compensating for degradation of the element driver or the electro-optical element, or combinations thereof.

18. An article of manufacture as claimed in claim 16, wherein said providing comprises operating multiple element drivers in a row of element drivers to a predetermined current and calibrating one or more of the element drivers to the predetermined current level.

19. An information handling system, comprising:

a display interface;

a backplane coupled to the display interface, wherein the backplane comprises:

an organic layer comprising an array of electro-optical elements; and an array of pixel circuits to drive the electro-optical elements, wherein the pixel circuits comprise an element driver coupled to the electro-optical element and a first capacitor comprising a storage capacitor coupled to the element driver to maintain a voltage on the element driver, a programming switch coupled to the element driver, and a driver switch coupled to the programming switch and the element driver, wherein the driver switch comprises a drive switch transistor coupled with a second capacitor comprising a drive switch capacitor and wherein the second capacitor comprising the drive switch capacitor is selectively coupled together with the first capacitor comprising the storage capacitor via operation of the drive switch transistor to change an operational state of the element driver;

wherein the driver switch operates to isolate the second capacitor from the first capacitor in a first mode of operation, and to couple the second capacitor with the first capacitor in a second mode of operation;

wherein the driver switch is capable of controlling when the element driver is turned on and turned off via a selected waveform applied to the drive switch transistor to drive the electro-optical element at a lower drive current set by the selected waveform which controls the coupling of the second capacitor with the first capacitor in the second mode of operation in response to an input programming signal being less than a threshold, and to otherwise drive the electro-optical element at a higher drive current via a voltage on the first capacitor comprising the storage capacitor wherein the second capacitor is isolated from the first capacitor in the first mode of operation.

20. An information handling system as claimed in claim 19, further comprising a processor coupled with the display interface.

21. An information handling system as claimed in claim 19, further comprising a touch a touch screen adjacent to the backplane to receive an input to control a processor.

* * * * *